US008278611B2

(12) United States Patent
Shpund et al.

(10) Patent No.: US 8,278,611 B2
(45) Date of Patent: Oct. 2, 2012

(54) AIRBORNE GUIDED SHELL

(75) Inventors: Zalman Shlomo Shpund, Kiryat Motzkin (IL); David Sahar, D.N. Misgav (IL)

(73) Assignee: Rafael Advanced Defense Systems Ltd., Haifa (IL)

( * ) Notice: Subject to any disclaimer, the term of this patent is extended or adjusted under 35 U.S.C. 154(b) by 553 days.

(21) Appl. No.: 12/375,654

(22) PCT Filed: Oct. 23, 2007

(86) PCT No.: PCT/IL2007/001267

§ 371 (c)(1),
(2), (4) Date: Oct. 1, 2009

(87) PCT Pub. No.: WO2008/050322

PCT Pub. Date: May 2, 2008

(65) Prior Publication Data

US 2010/0044495 A1 Feb. 25, 2010

(30) Foreign Application Priority Data

Oct. 24, 2006 (IL) ..... 178840

(51) Int. Cl.

| | |
|---|---|
| ***F41G 7/00*** | (2006.01) |
| ***F42B 15/01*** | (2006.01) |
| ***F42B 10/62*** | (2006.01) |
| *F42B 15/00* | (2006.01) |
| *F42B 10/60* | (2006.01) |

(52) U.S. Cl. ..... 244/3.15; 244/3.1; 244/3.11; 244/3.24; 244/3.27; 102/382; 102/384; 102/473; 102/501; 701/400; 701/408; 701/468

(58) Field of Classification Search ..... 244/3.1–3.3; 89/1.11, 1.51, 1.56, 6, 6.5; 102/382–384, 102/473, 490, 501; 701/200, 207, 213–216, 701/400, 408, 468

See application file for complete search history.

(56) References Cited

U.S. PATENT DOCUMENTS

| | | | | | |
|---|---|---|---|---|---|
| 3,164,339 | A | * | 1/1965 | Schroader et al. | 244/3.13 |
| 3,169,727 | A | * | 2/1965 | Schroader et al. | 244/3.13 |
| 3,179,355 | A | * | 4/1965 | Pickering et al. | 244/3.14 |
| 3,568,954 | A | * | 3/1971 | McCorkle, Jr. | 244/3.2 |
| 3,598,344 | A | * | 8/1971 | Walters et al. | 244/3.11 |
| 3,680,749 | A | * | 8/1972 | Davis | 244/3.14 |
| 3,695,555 | A | * | 10/1972 | Chadwick | 244/3.14 |
| 3,741,502 | A | * | 6/1973 | Schroader et al. | 244/3.13 |
| 3,758,052 | A | * | 9/1973 | McAlexander et al. | 244/3.14 |
| 3,803,974 | A | * | 4/1974 | Everest et al. | 89/1.56 |
| 3,897,028 | A | * | 7/1975 | Doellner | 244/3.1 |
| 4,037,202 | A | * | 7/1977 | Terzian | 244/3.11 |
| 4,093,153 | A | * | 6/1978 | Bardash et al. | 244/3.14 |
| 4,431,147 | A | * | 2/1984 | Paley | 244/3.3 |
| 4,711,152 | A | * | 12/1987 | Fortunko | 89/6.5 |
| 5,048,771 | A | * | 9/1991 | Siering | 244/3.15 |
| 5,054,712 | A | * | 10/1991 | Bar et al. | 244/3.22 |
| 5,080,300 | A | * | 1/1992 | Stubbs et al. | 244/3.11 |

(Continued)

*Primary Examiner* — Bernarr Gregory
(74) *Attorney, Agent, or Firm* — Merchant & Gould P.C.

(57) ABSTRACT

A kit for upgrading a non-guided shell to an airborne guided shell includes a device to couple the kit to the body of the non-guided shell. A fastener provides for fastening the resulting airborne shell to an aircraft and for detaching it there from. The kit also provides for causing the trajectory of the shell to change once detached from the aircraft according to instructions received in the kit; for determining the position of the shell; and for transferring data from the carrying platform to the guidance kit.

15 Claims, 3 Drawing Sheets

U.S. PATENT DOCUMENTS 5,096,139 A * 3/1992 Feld et al. ..... 244/3.1
5,118,050 A * 6/1992 Arnold et al. ..... 244/3.14
5,123,610 A * 6/1992 Oaks ..... 244/3.12
5,131,602 A * 7/1992 Linick ..... 244/3.14
5,229,538 A * 7/1993 McGlynn et al. ..... 89/1.56
5,433,399 A * 7/1995 Becker et al. ..... 244/3.22
5,443,227 A * 8/1995 Hsu ..... 244/3.12
5,467,940 A * 11/1995 Steuer ..... 244/3.11
5,474,255 A * 12/1995 Levita ..... 244/3.14
5,507,452 A * 4/1996 Mayersak ..... 244/3.15
5,657,947 A * 8/1997 Mayersak ..... 244/3.19
5,775,636 A * 7/1998 Vig et al. ..... 244/3.24
5,866,838 A 2/1999 Mayersak
6,237,496 B1 * 5/2001 Abbott ..... 102/384
6,254,031 B1 * 7/2001 Mayersak ..... 244/3.22
6,474,592 B1 * 11/2002 Shnaps ..... 244/3.15
6,481,666 B2 * 11/2002 Frucht ..... 244/3.15
6,540,175 B1 * 4/2003 Mayersak et al. ..... 244/3.15
6,685,134 B2 * 2/2004 Trosky et al. ..... 244/3.22
6,779,752 B1 * 8/2004 Ratkovic ..... 244/3.15
6,883,747 B2 * 4/2005 Ratkovic et al. ..... 244/3.15
6,889,934 B1 * 5/2005 Thomas et al. ..... 244/3.19
6,919,840 B2 * 7/2005 Friedrich et al. ..... 244/3.15
7,121,502 B2 * 10/2006 Krikorian et al. ..... 244/3.14
7,416,154 B2 * 8/2008 Bittle et al. ..... 244/3.22
7,795,567 B2 * 9/2010 Schneider ..... 244/3.26
2007/0256587 A1 * 11/2007 Shpund ..... 102/384

* cited by examiner

AIRBORNE GUIDED SHELL

This application is a National Stage Application of PCT/IL2007/001267, filed 23 Oct. 2007, which claims benefit of Serial No. 178840, filed 24 Oct. 2006 in Israel and which applications are incorporated herein by reference. To the extent appropriate, a claim of priority is made to each of the above disclosed applications.

FIELD OF THE INVENTION

The present invention relates to the field of weapons and ammunitions. More particularly, the invention relates to airborne explosive charges.

BACKGROUND OF THE INVENTION

Airborne explosive devices are used in warfare for various purposes. Many different types of guided explosive devices exist, ranging from guided bombs discharged by an airplane, up to highly sophisticated guided missiles, such as air-to-air or air-to-ground missiles.

One disadvantage of air-to-ground guided charges is their complexity and their resulting cost. Because of the need for sophisticated guiding systems, such charges are complicated to make, and in many cases their sophistication is overqualified for a specific task.

There is, therefore, a need for air-to-ground explosive charges, which can be dropped from an aircraft (whether manned or not), and which can then be guided, which are relatively inexpensive and rely on staple and mass-produced charges.

It is an object of the present invention to provide such a low-cost, highly convenient guided charge.

It is the object of the invention to provide a kit that can be used to transform a non-guided explosive charge into an airborne, guided charge.

It is yet another purpose of the invention to provide a method and a kit by which a simple artillery shell can be transformed into a guided, airborne charge.

Other purposes and advantages of the invention will become apparent as the description proceeds.

SUMMARY OF THE INVENTION

In one aspect, the invention is directed to an airborne guided shell, comprising a non-guided regular artillery shell, coupled with a guiding kit. Such non-guided artillery shell may be, for instance, a 155 mm shell or a mortar shell, or any other suitable charge.

In another aspect the invention is directed to a kit for upgrading a non-guidable shell to an airborne guidable shell, which comprises: (a) means to couple said kit to the body of said non-guidable shell; (b) means for fastening the resulting airborne shell to an aircraft and for detaching it there from; (c) means for causing the trajectory of the shell to change once detached from the aircraft according to instructions received in the kit; (d) means for determining the position of the shell; and (e) means to transfer data from the carrying platform to the guidance kit.

According to a preferred embodiment of the invention the means for causing the trajectory of the shell to change comprise one or more flap(s), each flap being movable by a servo mechanism.

According to another preferred embodiment of the invention the means for determining the position of the shell comprise a GPS system.

In a further aspect, the invention relates to a method for manufacturing an airborne guided shell from a non-guided artillery shell, comprising coupling said non-guided artillery shell with a guiding kit.

DETAILED DESCRIPTIONS OF PREFERRED EMBODIMENTS

Figure 1:
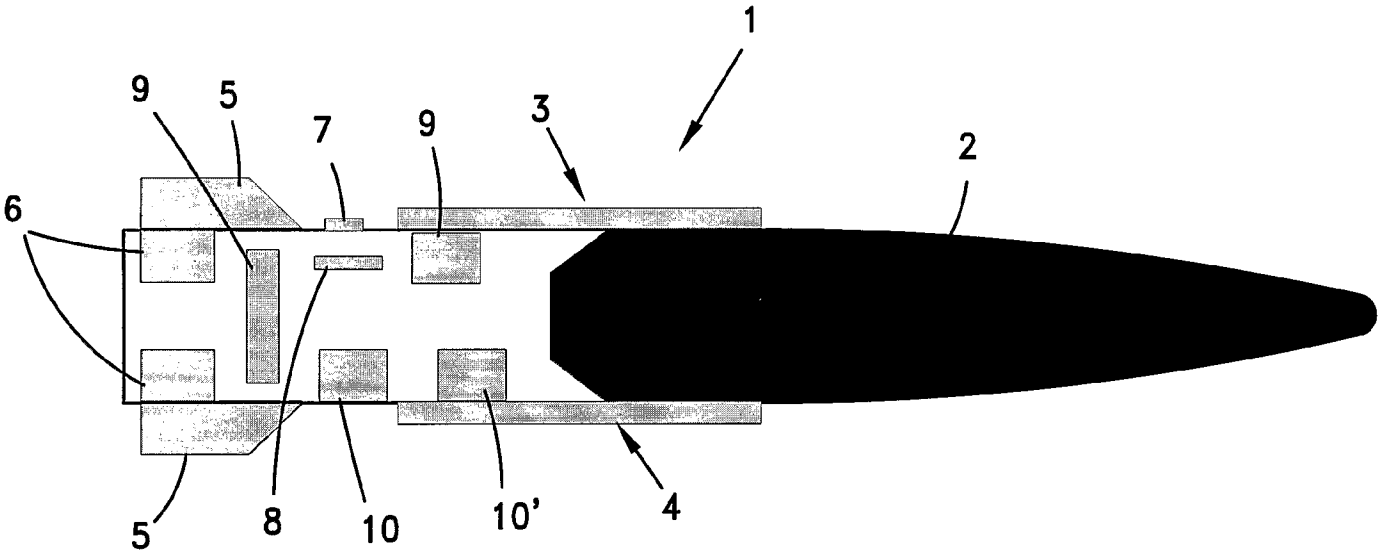
FIG. 1 schematically illustrates an airborne guided shell, according to a preferred embodiment of the invention.

FIG. 1 illustrates the invention, in one particular embodiment thereof. The Airborne Guided Shell 1 consists of two main elements: an explosive shell, as may be a simple 155 mm artillery shell, and an adapting kit 3, which is coupled with the shell, e.g., by using an elongated housing 4 that encapsulates it, or by any other suitable means, which will be apparent to the skilled person and which is therefore not discussed herein in detail, for the sake of brevity.

Shell 1 can be carried by any suitable flying machine, as may be a fighter aircraft, and released from it when in a substantially ballistically suitable positioned relationship with respect to the target. Guiding of the shell, as will be explained below, allows for a more precise hit of the target.

As will be appreciated by the skilled person, the invention is general in nature and is not limited to a 155 mm shell, or to any particular type of ammunition. For instance, smaller aircrafts may exploit smaller caliber shells, such as mortar shells, which have been transformed into a guided airborne shell by a kit of suitable dimensions.

Kit 3 comprises a number of modules, which are designed to fractionalize the simple artillery shell and to turn it into a guidable shell. In the preferred embodiment of FIG. 1, for instance, driving flaps 5 are provided, the position of which can be changed by means of actuators 6, which will change the position of the flaps, according to instructions received, e.g., by a CPU, thus causing the shell to change its trajectory toward its target.

Exact positioning of the shell can be easily provided at all times by using a GPS (ground positioning system), or by any other suitable means. In the illustrative example of FIG. 1, a GPS antenna 7 and a GPS receiver 8 are provided. Data from the GPS and other devices of the kit are received in CPU 9, which controls the operation of the kit. The CPU also performs a variety of other tasks, such as communicating with the carrying platform, flight control, positioning algorithm, trajectory calculations, etc.

Additional elements can be provided in kit 3. For instance, a power source 9 and release mechanisms 10 and 10' (for releasing the shell from the aircraft) can also be housed in the kit, along with additional devices and mechanisms (not shown).

Figure 2:
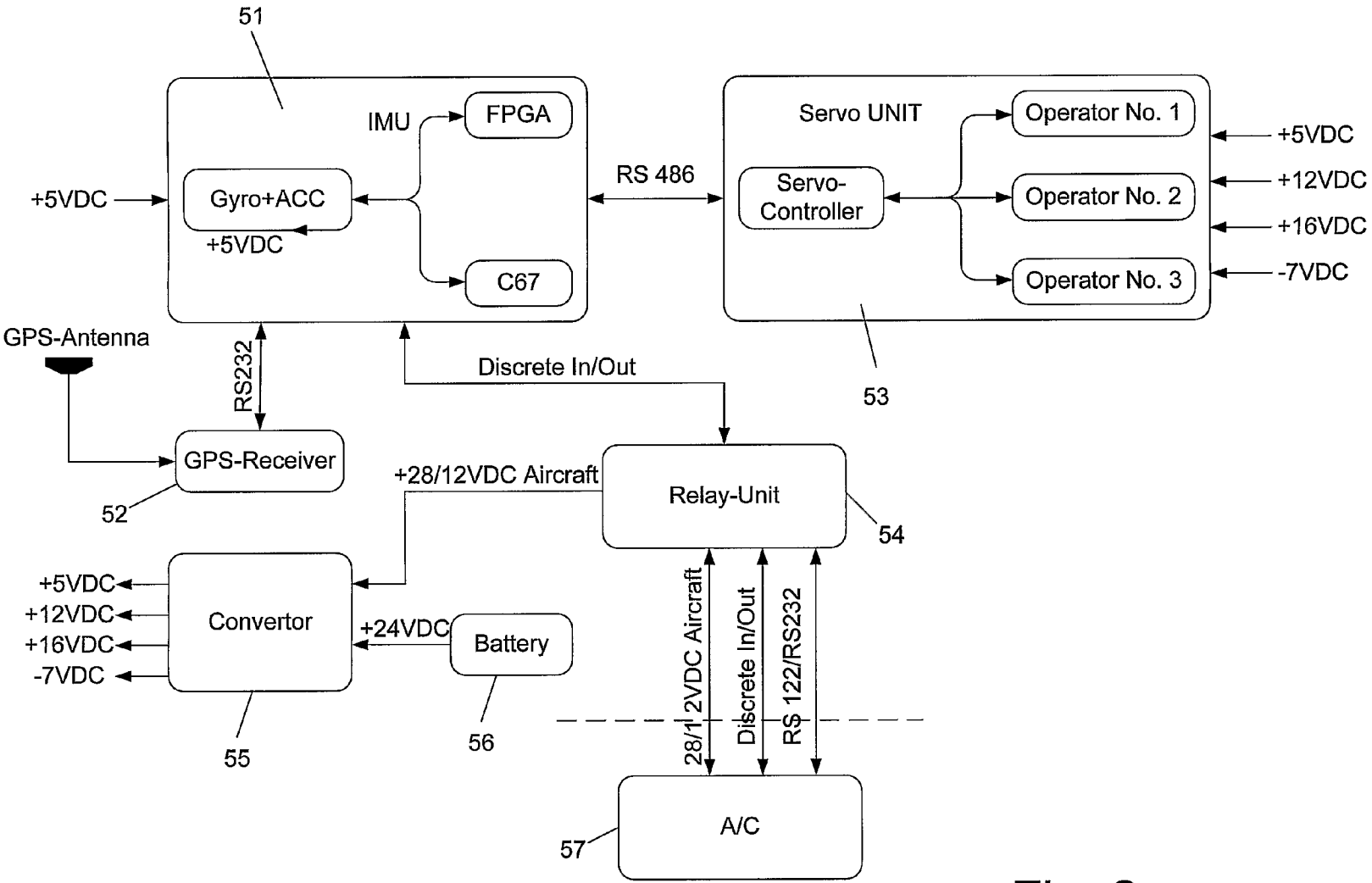
FIG. 2 is a block diagram illustrating the relations of the various avionic elements of a kit, according to a preferred embodiment of the invention.

FIG. 2 schematically shows the relationships of various avionic elements of the kit of FIG. 1. Of course, these relationships are only illustrative and the skilled person will be able to device many alternative ways to operate the devices of kit 3. The Mission Computer is integrated with the Navigation Computer in the IMU system 51. The IMU receives its location and orientation updates from the GPS receiver 52. Flight directions are sent to the Flight Control Computer integrated in the Servo Unit 53, which as said serves as the Flight Control System. During captive flight, mission data like target location, flight direction, navigation data and electric power are supplied from the Aircraft (A/C) 57 and are distributed to the system via Relay Unit 54 and power converter 55. Prior to separation from the A/C 57, Battery 56 is activated to supply the required electric power during the free flight.

Figure 3:
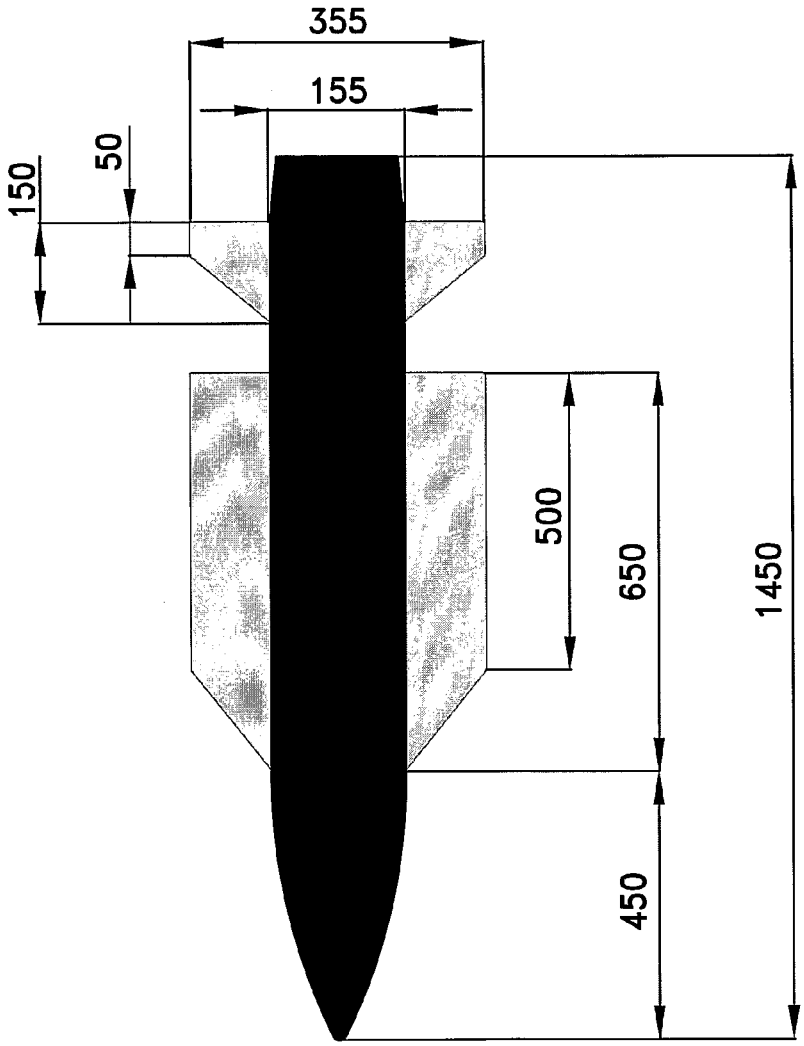
FIG. 3 shows the dimensions of a common 155 mm artillery shell that can be used according to the invention.

FIG. 3 shows the actual dimensions of a standard 155 mm artillery shell, which are provided to illustrate typical dimensions and, as already emphasized, are not intended to limit the invention in any way, and the invention is intended to employ also explosive charges of much smaller as well as much larger dimensions.

When it is desired to turn a shell, such as that of FIG. 3, into an airborne guided shell, all that is needed is to provide a kit of suitable dimensions, such as kit 3 of FIG. 1, and to securely fasten it to the shell. No changes to the mechanism or inner parts of the shell are needed, thus making the process a simple and inexpensive one.

As will be apparent to the skilled person, the ability to use staple, simple artillery shells to perform complex tasks for which airborne guided shells are needed, is of considerable advantage and obtains substantial practical and economical advantages.

While some embodiments of the invention have been described by way of illustration, it will be apparent that the invention can be carried into practice with many modifications, variations and adaptations, and with the use of numerous equivalents or alternative solutions that are within the scope of persons skilled in the art, without departing from the spirit of the invention or exceeding the scope of the claims.

The invention claimed is:

1. An airborne guided shell, comprising a non-guided artillery shell, coupled with a guiding kit, said guiding kit comprising means for receiving at least navigation data from a carrying platform, and means at said guiding kit for causing the trajectory of the guided shell once detached from the carrying platform to change based on said at least navigation data as received from said carrying platform.

2. A shell according to claim 1, wherein the guiding kit is securely coupled to the body of the shell.

3. A shell according to claim 1, wherein the non-guided artillery shell is a 155 mm shell.

4. A shell according to claim 1, wherein the non-guided artillery shell is a mortar shell.

5. An airborne guided shell according to claim 1, wherein means for receiving at least navigation data from the carrying platform is selected from the group consisting of: mission data, flight direction, and electric power.

6. A kit for upgrading a non-guidable shell to an airborne guidable shell, comprising:

means for coupling said kit to the body of said non-guidable shell;

means for fastening the airborne guidable shell to an aircraft and for detaching the airborne guidable shell therefrom;

means for causing the trajectory of the airborne guidable shell to change, once detached from the aircraft, according to instructions received in the kit; and means for determining the position of the airborne guidable shell;

means for receiving at least navigation data from the carrying platform.

7. A kit according to claim 6, wherein the means for causing the trajectory of the airborne guidable shell to change comprise one or more flaps, each flap being movable by a servo mechanism.

8. A kit according to claim 6, wherein the means for determining the position of the airborne guidable shell comprise a GPS system.

9. A method for adapting a non-guided artillery shell that allows a shell to be guided, said method comprising coupling said non-guided artillery shell with a guiding kit, said guiding kit comprising means for receiving at least navigation data from a carrying platform, and means at said guiding kit for causing the trajectory of said adapted shell to change once detached from the platform based on said at least navigation data.

10. A method according to claim 9, comprising coupling the guiding kit to the body of the shell.

11. A method according to claim 9, further comprising:

coupling said kit to the body of said non-guided shell;

fastening the adapted airborne shell to an aircraft or detaching said adapted airborne shell there from;

causing the trajectory of the adapted airborne shell to change, once detached from the aircraft, according to instructions received in the kit;

determining the position of the adapted airborne shell; and transferring at least navigation data from the carrying platform to the guidance kit.

12. A method according to claim 11, wherein the means for causing the trajectory of the shell to change comprise one or more flaps, each flap being movable by a servo mechanism.

13. A method according to claim 11, wherein the means for determining the position of the shell comprise a GPS system.

14. A method according to claim 9, wherein the non-guided artillery shell is a 155 mm shell.

15. A method according to claim 9, wherein the non-guided artillery shell is a mortar shell.

* * * * *